US012520947B2

(12) United States Patent
Faltenbacher

(10) Patent No.: US 12,520,947 B2
(45) Date of Patent: Jan. 13, 2026

(54) FOLDING BED STORAGE CABINETS

(71) Applicant: GCMB Inc., Cape Coral, FL (US)

(72) Inventor: Peter Ferdinand Faltenbacher, Baki Sukohara (ID)

(73) Assignee: GCMB Inc., Cape Coral, FL (US)

( * ) Notice: Subject to any disclaimer, the term of this patent is extended or adjusted under 35 U.S.C. 154(b) by 157 days.

(21) Appl. No.: 18/372,826

(22) Filed: Sep. 26, 2023

(65) Prior Publication Data

US 2025/0098867 A1 Mar. 27, 2025

(51) Int. Cl.
*A47C 17/60* (2006.01)
*A47C 17/58* (2006.01)

(52) U.S. Cl.
CPC ..... *A47C 17/60* (2013.01); *A47C 17/58* (2013.01)

(58) Field of Classification Search
CPC ..... A47C 17/52; A47C 17/54; A47C 17/56; A47C 17/58; A47C 17/60
See application file for complete search history.

(56) References Cited

U.S. PATENT DOCUMENTS 5,182,824 A * 2/1993 Cipriano ..... A47D 11/005 5/2.1
9,993,088 B2 * 6/2018 Porter ..... A47C 19/12
10,413,076 B2 * 9/2019 Flora ..... A47C 17/60
11,324,327 B2 * 5/2022 Grossman ..... A47C 17/54
11,638,486 B2 * 5/2023 Gwee ..... A47C 17/58 5/2.1
11,839,306 B2 * 12/2023 Valone ..... A47C 19/12
D1,066,939 S * 3/2025 Valone ..... D6/384
2015/0223606 A1 * 8/2015 Gerstle ..... F16B 5/0012 297/452.1
2016/0037934 A1 * 2/2016 Porter ..... A47C 19/12 5/174
2016/0324326 A1 * 11/2016 McCoy ..... A47C 17/52
2019/0191889 A1 * 6/2019 Flora ..... A47C 19/22
2019/0343292 A1 * 11/2019 Porter ..... A47C 17/58
2020/0069067 A1 * 3/2020 Valone ..... A47C 17/60
2020/0170415 A1 * 6/2020 Broussard ..... A47C 17/165
2021/0076832 A1 * 3/2021 Gwee ..... A47C 19/024
2022/0273107 A1 * 9/2022 Porter ..... A47C 17/58
2023/0098731 A1 * 3/2023 Porter ..... A47C 19/12 5/174
2023/0108840 A1 * 4/2023 Grossman ..... A47C 17/60 5/174
2025/0228372 A1 * 7/2025 Flora ..... A47C 17/58
2025/0325113 A1 * 10/2025 Barth ..... A47C 17/52

FOREIGN PATENT DOCUMENTS

CA 3010271 C * 9/2020 ..... A47B 85/08

* cited by examiner

*Primary Examiner* — David E Sosnowski
(74) *Attorney, Agent, or Firm* — Brannon Sowers & Cracraft PC

(57) ABSTRACT

Chests and cabinets configured to transition between a closed (stowed) position and an open (deployed) position having a folding mattress and a mattress platform stored within. The chest or cabinets may include a separable portion which acts as a support for the mattress platform when the cabinet is in the deployed position and as a drawer when in the stowed position. The mattress platform includes at least one feature for securing it to the separable portion when in the deployed position.

19 Claims, 9 Drawing Sheets

FOLDING BED STORAGE CABINETS

FIELD

The claimed technology relates generally to furniture and more particularly to cabinets which store and conceal folding beds that may be deployed therefrom for use.

BACKGROUND

In both private residences and commercial settings there is often a need for temporary sleeping arrangements. Keeping a traditional bed in a room isn't always practicable, especially when such extra sleeping space is not used frequently. One common solution is the sofa bed or futon. While such multi-function articles of furniture allow for a space to be temporarily converted for use as extra sleeping spaces, such articles tend to perform poorly in both of their dual roles. Sofa beds and futons are notoriously uncomfortable and/or unsightly when used for seating and as beds. There remains a need for articles of furniture which store folding beds which are both attractive and useful when the bed is stowed as well as comfortable when the bed is deployed for use.

SUMMARY

In one aspect a sleeper bed cabinet is provided which is configured to transition between a stowed position and a deployed position having a top panel with a first portion and a second portion, the first portion being configured to fold back onto the second portion, two side panels, and a rear panel defining an interior cabinet volume, an interior panel disposed between the two side panels and below the top panel and dividing the interior cabinet volume into an upper interior volume and a lower interior volume, and a front panel having a first subpanel hingeably mounted to the interior panel and a second subpanel hingeably mounted to the first subpanel and having at least one securing cleat. The cabinet further includes a separable platform stowable in the lower interior volume and having a securing ledge with at least one securing recess configured to accept the at least one securing cleat. The front panel may be configured to transition between a raised (stowed) position and a lowered (deployed) position, the first subpanel forming a medial mattress platform and the second subpanel forming a distal mattress platform in the lowered (deployed) position. The separable platform is removable and completely detached from the lower interior volume and positionable to form a support platform for the second front panel subpanel. The at least one securing cleat is secured to the at least one securing recess when the separable platform is supporting the second front panel subpanel to prevent movement of the separable platform when the cabinet is in the deployed position. The sleeper bed cabinet may further include a support leg and wherein the front panel first subpanel further includes a corresponding support leg attachment point positioned such that a support leg attached to the attachment point supports the front panel first subpanel when in the deployed position. When in the closed position, the cabinet top panel first portion covers the support leg attachment point so it is not visible.

In another aspect a sleeper bed cabinet is provided which is configured to transition between an open position and a closed position, the cabinet having a top panel with a first portion and a second portion, the first portion being hinged to fold back onto the second portion, two side panels, and a rear panel defining an interior cabinet volume, an interior panel disposed between the two side panels and below the top panel dividing the interior cabinet volume into an upper interior volume and a lower interior volume and which forms a proximal portion of a sleeping platform when the cabinet is in the open position, a front panel having a first subpanel hingeably mounted to the interior panel and a second subpanel hingeably mounted to the first subpanel and having at least one securing feature, and a separable platform stowable in the lower interior volume and having a securing ledge with at least one securing recess configured to accept the at least one securing feature. The cabinet front panel is configured to transition between a raised position and a lowered position, the first subpanel forming a medial portion of a sleeping platform and the second subpanel forming a distal portion of a sleeping platform when in the lowered position. The separable platform is removable from the lower interior volume and positionable to form a support platform for the second front panel subpanel when the cabinet is in the open position such that the at least one securing feature is secured to the at least one securing recess when the separable platform is supporting the second front panel subpanel.

In still another aspect a sleeper bed cabinet configured to transition between a stowed position and a deployed position includes a top panel having a first portion and a second portion, the first portion being hinged to fold back onto the second portion, two side panels, a rear panel, and a front panel defining a cabinet interior volume where an interior panel is disposed between the two side panels, the front and rear panels, and below the top panel dividing the cabinet interior volume into an upper interior volume and a lower interior volume, the interior panel forming a proximal portion of a mattress platform when the cabinet is in the deployed position. The front panel includes a solid first subpanel hingeably mounted to the interior panel and a slatted second subpanel hingeably mounted to the first subpanel and having at least one securing cleat. Also provided is a separable platform stowable in the lower interior volume and having a securing ledge with at least one securing recess configured to accept the at least one securing cleat. The front panel is configured to transition between a raised position when the cabinet is in the stowed position and a lowered position when the cabinet is in the deployed position, the first subpanel forming a medial portion of a mattress platform and the second subpanel forming a distal portion of a mattress platform when in the lowered position. The separable platform is removable from the lower interior volume and positionable to form a support platform for the second front panel subpanel and the at least one securing cleat is secured to the at least one securing recess when the separable platform is supporting the second front panel subpanel when the cabinet is in the deployed position.

DESCRIPTION

Figure 1:
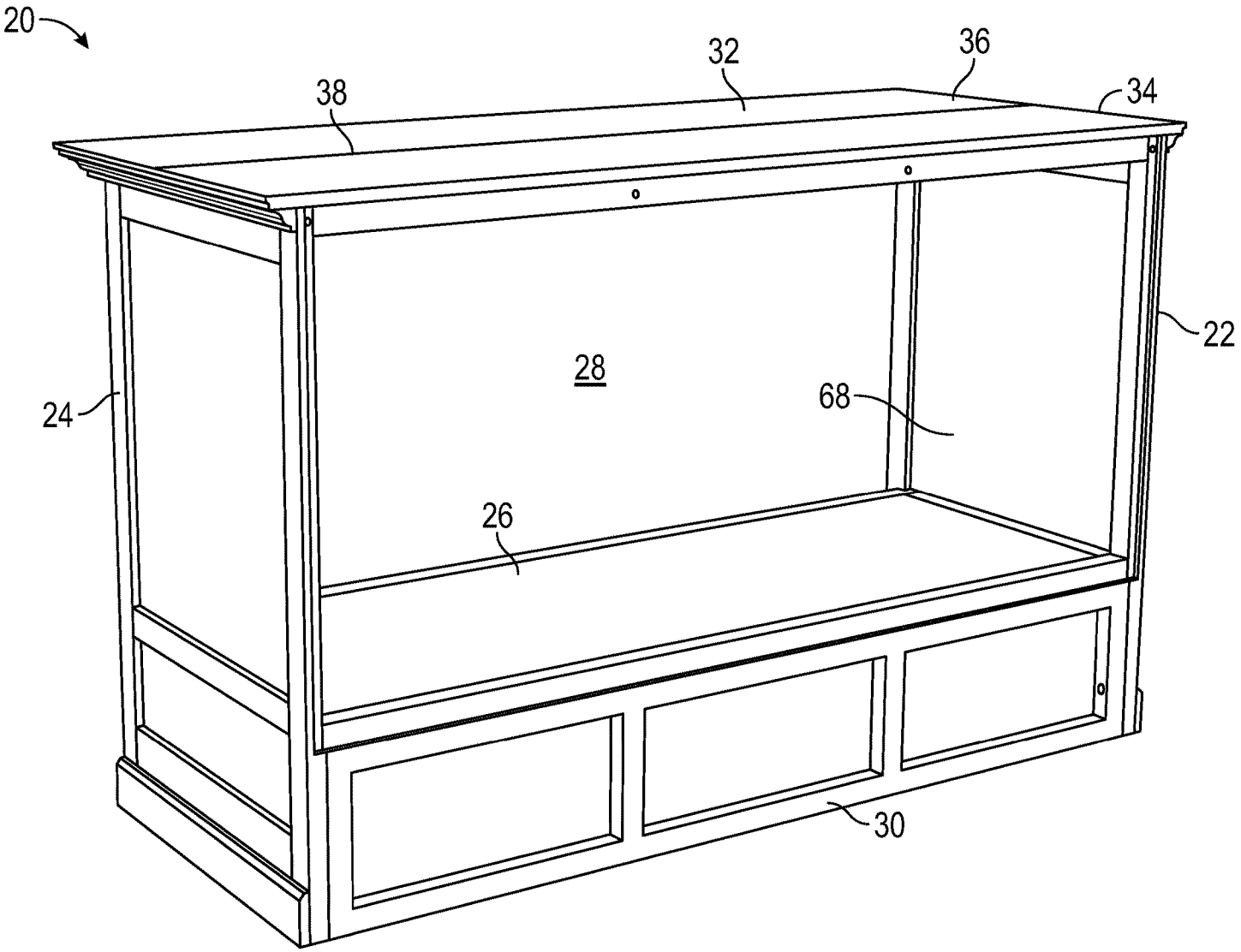
FIG. 1 is a front perspective view of a folding bed storage cabinet according to one embodiment.

For the purposes of promoting an understanding of the principles of the claimed technology and presenting its currently understood best mode of operation, reference will now be made to the embodiments illustrated in the drawings and specific language will be used to describe the same. It will nevertheless be understood that no limitation of the scope of the claimed technology is thereby intended, with such alterations and further modifications in the illustrated device and such further applications of the principles of the claimed technology as illustrated therein being contemplated as would normally occur to one skilled in the art to which the claimed technology relates.

The examples shown in the drawings are discussed herein as having a particular style. This has been done for illustrative purposes only. The functional features of the disclosed invention may be incorporated into any number of other styles of furniture and may include any desired ornamental/decorative features including, but not limited to, handles, knobs, latches, raised/recessed panels, decorative trim/molding/millwork, and the like. Additionally, the cabinets disclosed herein may also be finished, stained, and/or painted in any desired style/color. The cabinets disclosed herein are typically made from wood including solid wood, cross-banded wood veneer panels, engineered wood products/composites such as medium density fiberboard (MDF), high density fiber board (HDF), particle board, plywood, and the like or combinations thereof, but may also be made from synthetic materials. So-called CARB 2 compliant materials provide a practical implementation strategy.

Cabinets or other furniture incorporating the functional features disclosed herein may be assembled using traditional cabinetry and joinery methods (glue, screws, nails, and the like) and/or may be assembled by an end user from partially preassembled components. For example, individual panels may be preassembled at a factory, packaged together in a box/boxes for shipment to an end user (e.g., flat packed), and then assembled into a cabinet by the end user. Such partially or fully assembled pieces may ship with or without a mattress. The exact size and shape of cabinets incorporating the inventive features disclosed herein may vary as desired. Cabinets may be made taller or shorter and/or wider or narrower as desired. Such cabinets may also be sized so as to accommodate traditional mattress dimensions, for example, twin, full, queen, and the like.

Figure 2:
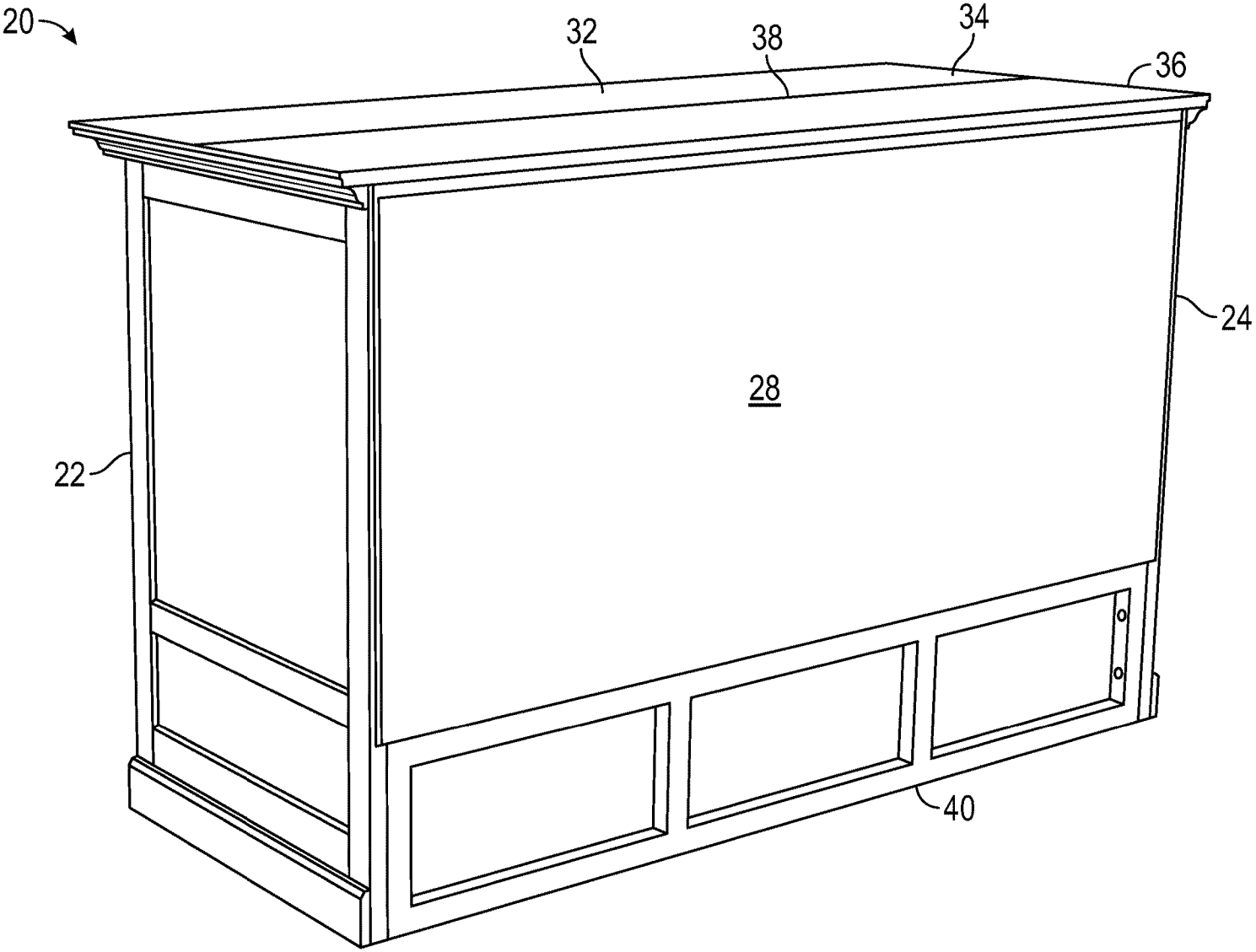
FIG. 2 is a rear perspective view of the folding bed storage cabinet of FIG. 1.
Figure 3:
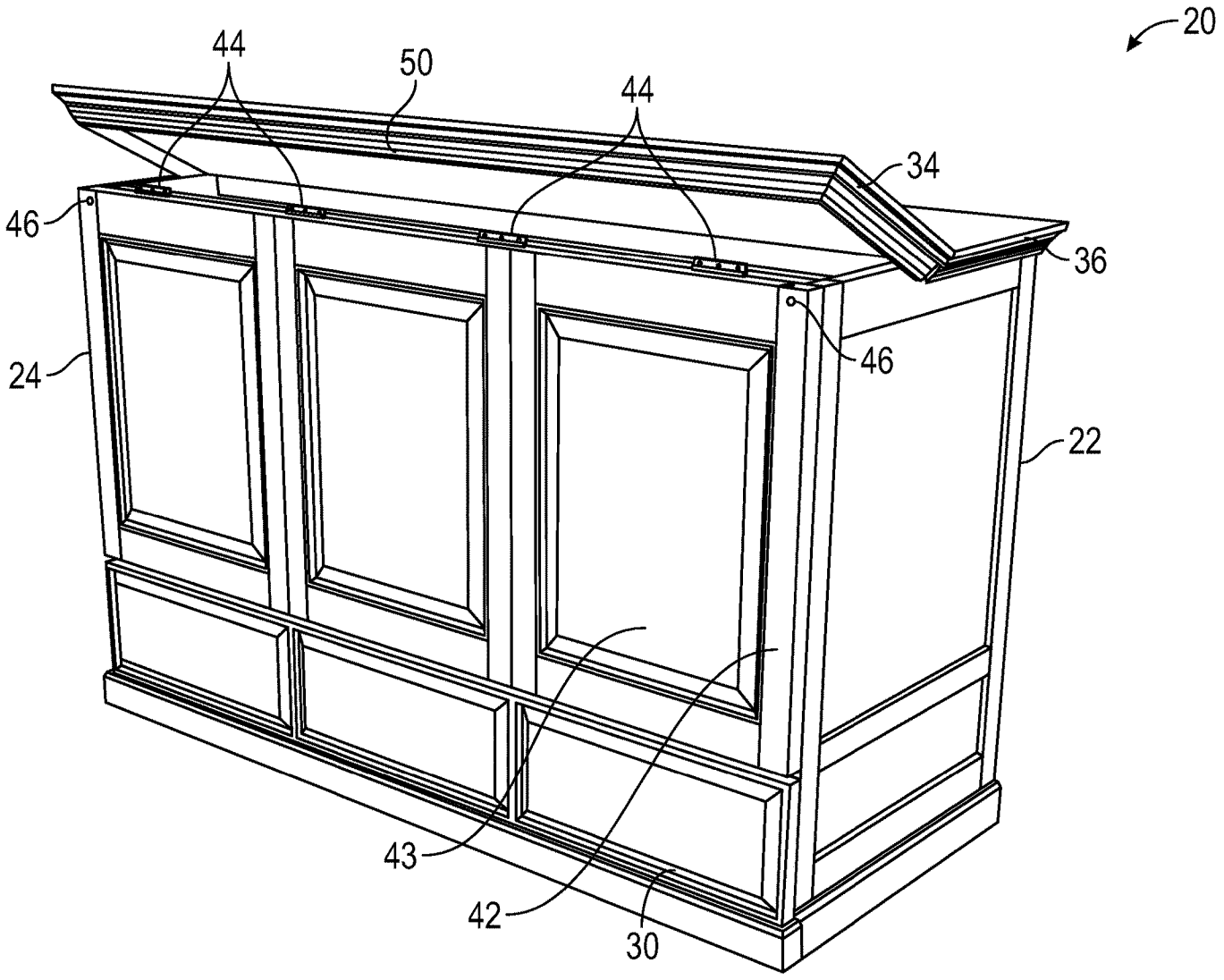
FIG. 3 is a front perspective view of the folding bed storage cabinet of FIG. 1 in a partially deployed position.
Figure 4:
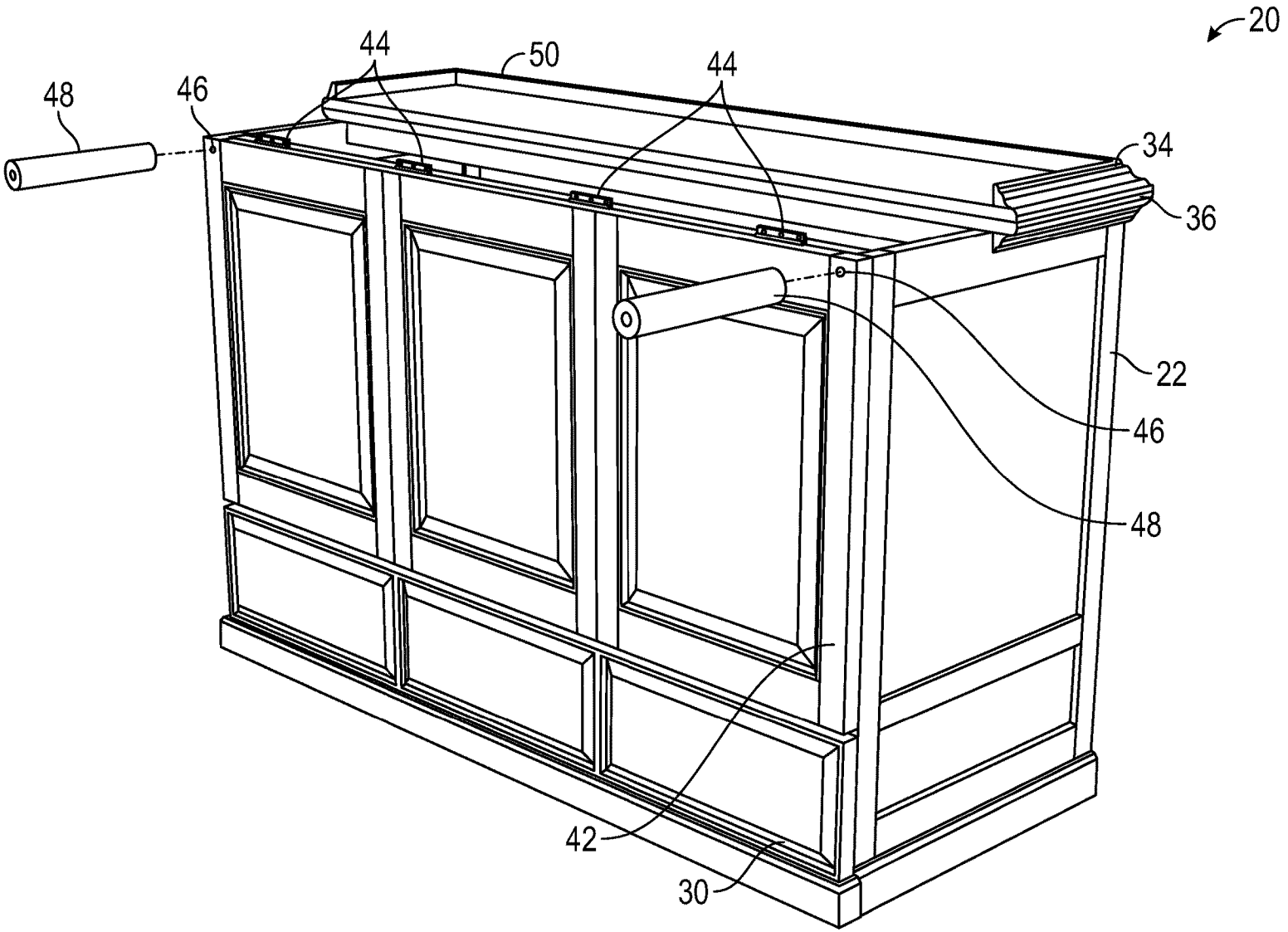
FIG. 4 is a front perspective view of the folding bed storage cabinet of FIG. 1 in a partially deployed position.
Figure 5:
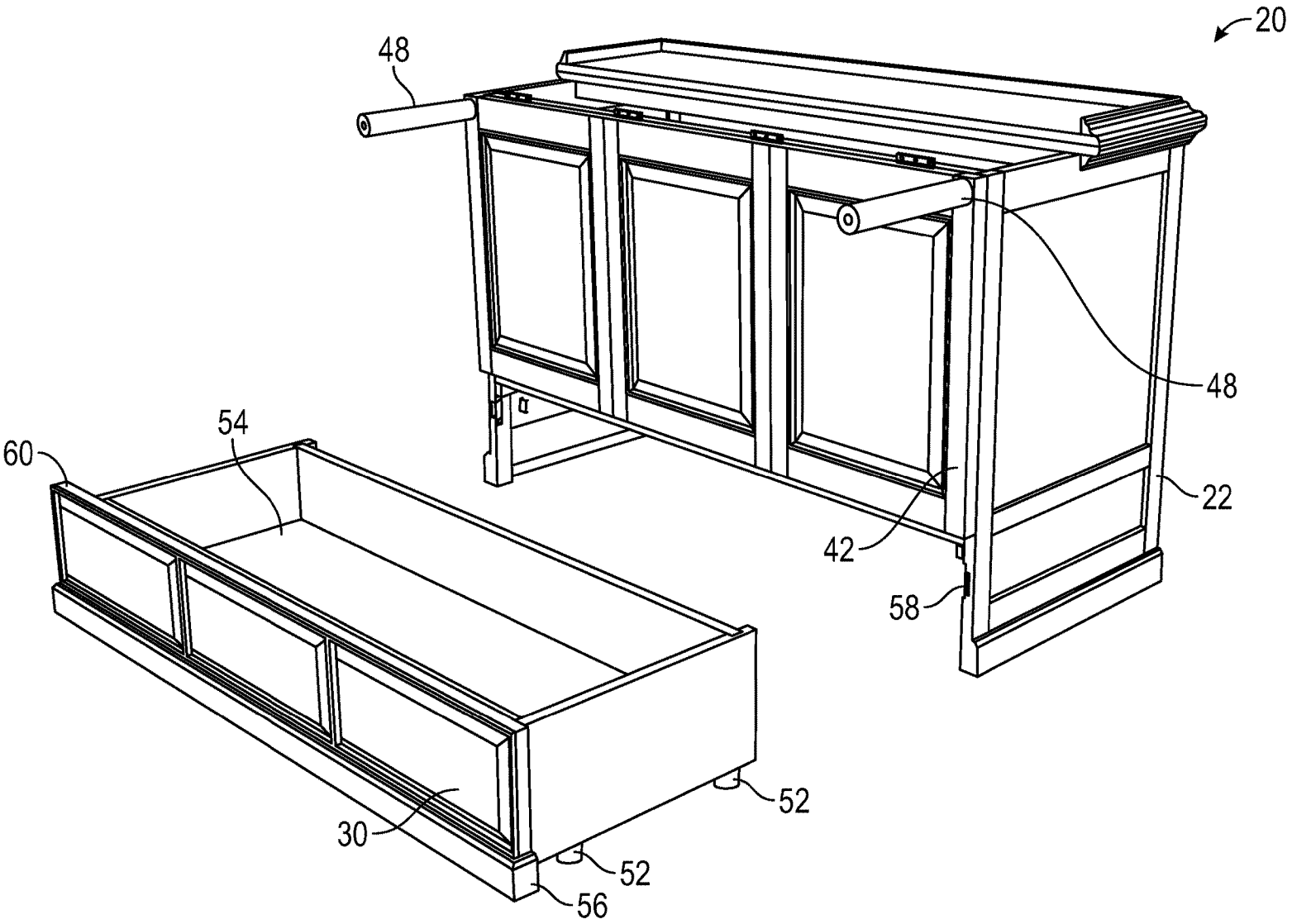
FIG. 5 is a front perspective view of the folding bed storage cabinet of FIG. 1 with the separable portion in the deployed position.

One example of a cabinet according to the disclosed invention is shown in FIGS. 1-8. FIG. 1 shows a front perspective view and FIG. 2 shows a rear perspective view of one example of a folding bed storage cabinet 20 according to the disclosed invention. In this example, the cabinet 20 is shown in a partially assembled condition with the front panel 42 removed for clarity. The cabinet 20 includes a right (first) side panel 22, a left (second) side panel 24, a top panel 32, a rear panel 28, and a front panel 42. An interior panel 26 divides the cabinet 20 interior into an upper interior volume 68 and a separable portion storage (lower) volume 58.

The top panel 32 is divided into a first portion 34 and a second portion 36 by a seam 38. When assembled, the second top portion 36 is fixed to the first side panel 22 and the second side panel 24 using any suitable means (glue, screws, nails, dowels, and the like) while the first top panel 34 is removably mounted to the side panels 22, 24. Optionally, the first top panel 34 is pivotably mounted to the second top panel 36 by one or more hinges 76. The first top panel 34 may be pivoted between a lowered/closed position (FIG. 1) where it rests on the front panel 42 and side panels 22, 24 and a raised/open position (FIG. 4) where it is back and onto the second top panel 36. The first top panel 34 may include a lip 50 which covers a portion of the front panel 42 and side panels 24, 26 when the first top panel 34 is in the lowered/closed position. One or more support structure attachment points 46 are disposed on the face of the front panel 42 such that they are concealed by the top panel lip 50 when the first top panel 34 is in the lowered/closed position and exposed when in the raised/open position. Each support structure attachment point 46 is configured to accept a corresponding support structure or leg 48. Any suitable connection method may be used, such as a threaded rod attached to one end of the support structure 48 and a corresponding threaded receptacle for each support structure attachment point 46. Bayonet mounts, push in connections, and other related types of connection may also be used. In this particular example the support structures 48 are shown as cylindrical legs, but other shapes/configurations may also be used.

The separable portion 30 is sized and configured such that it fits within the separable portion storage area 58 which is bounded by the first and second side panels 22, 24, the rear panel base 40 and the interior panel 26. The separable portion 58 in this example encompasses an interior volume 54 which may be used for storage (for linens, bedding, the support structures 48, and the like). The separable portion 30 further includes a lower trim piece 56, a securing ledge 60 and rollers 52. When in the closed position (such as in FIG. 1) the separable portion 30 fits within the separable portion storage area 58 so as to appear to be part of the cabinet 20 base. The lower trim piece 56 is sized and positioned such that it appears to be a part of the cabinet 20 base trim/molding. Optionally, the lower trim piece 56 also conceals the rollers 52 from view when the cabinet is in the closed position. The rollers 52 are sized and configured so as to allow the separable portion 30 to be easily moved across a floor surface as well as moved in and out of the separable portion storage area 58. Optionally, the rollers 52 may be replaced with wheels, padded rails, or other suitable structures which improve the separable structure's ability to be moved on floor surfaces.

In some examples, there may also be rails or guides within the separable portion storage area 58 and/or on the sides of the separable portion 30 to assist in sliding the separable portion 30 in and out of the separable portion storage area 58. Any such rails or guides do not connect the separable portion 30 to the cabinet. Rather, the separable portion 30 is completely disconnected from cabinet 20 once it has been removed from the separable portion storage area 58.

Figure 6:
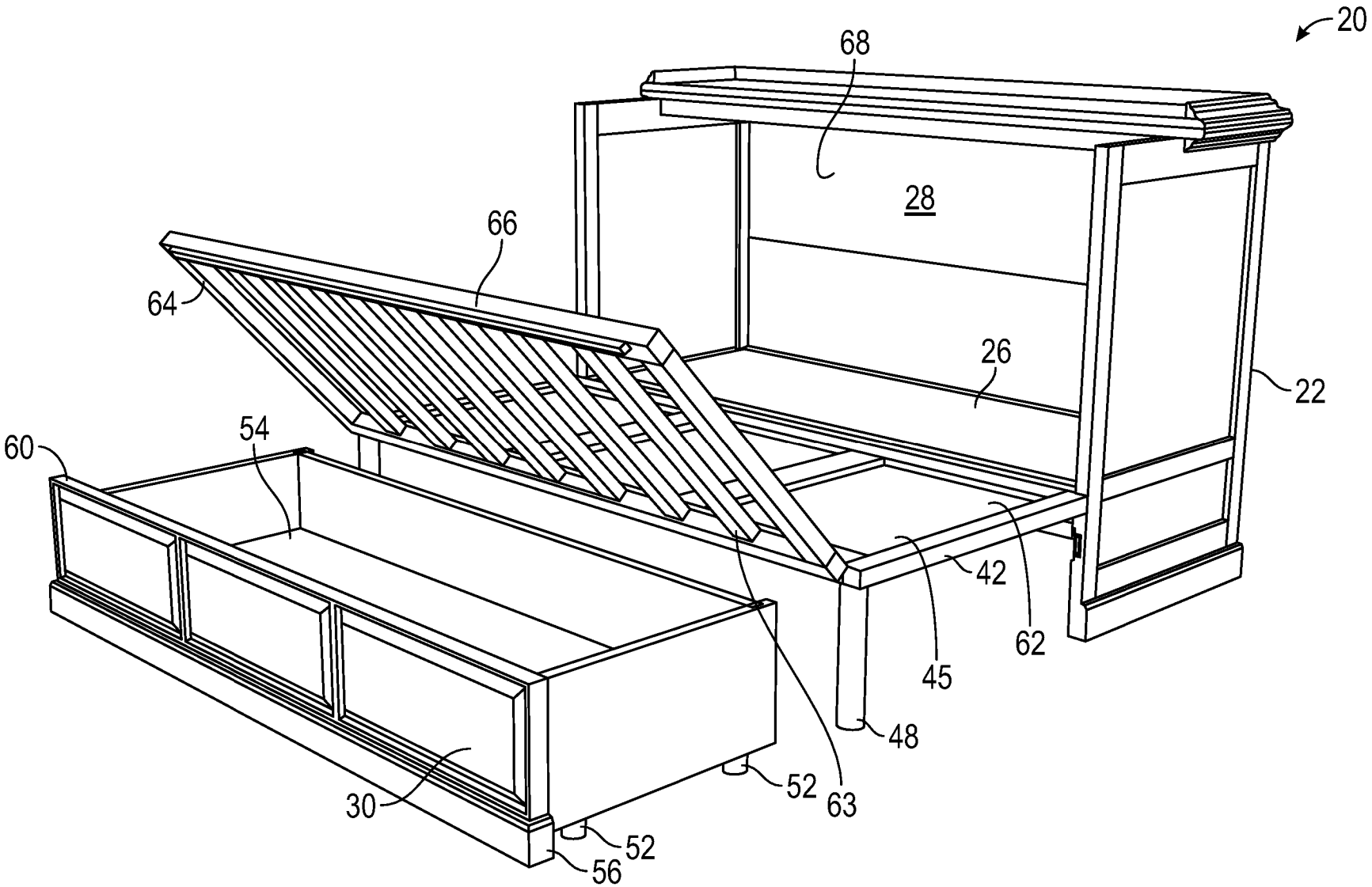
FIG. 6 is a front perspective view of the folding bed storage cabinet of FIG. 1 with the mattress platform in the partially deployed position.
Figure 7:
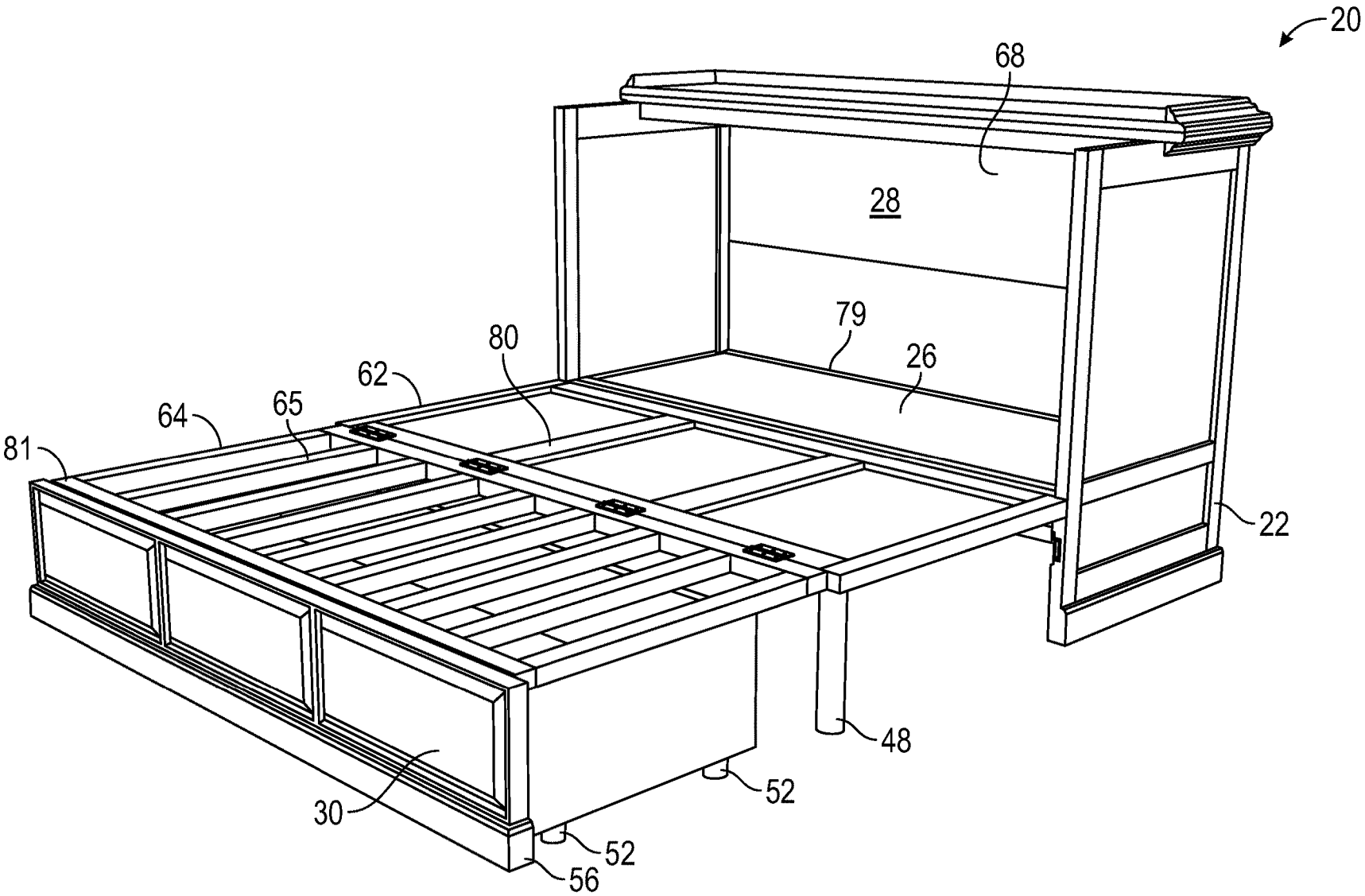
FIG. 7 is a front perspective view of the folding bed storage cabinet of FIG. 1 in the deployed position.
Figure 8:
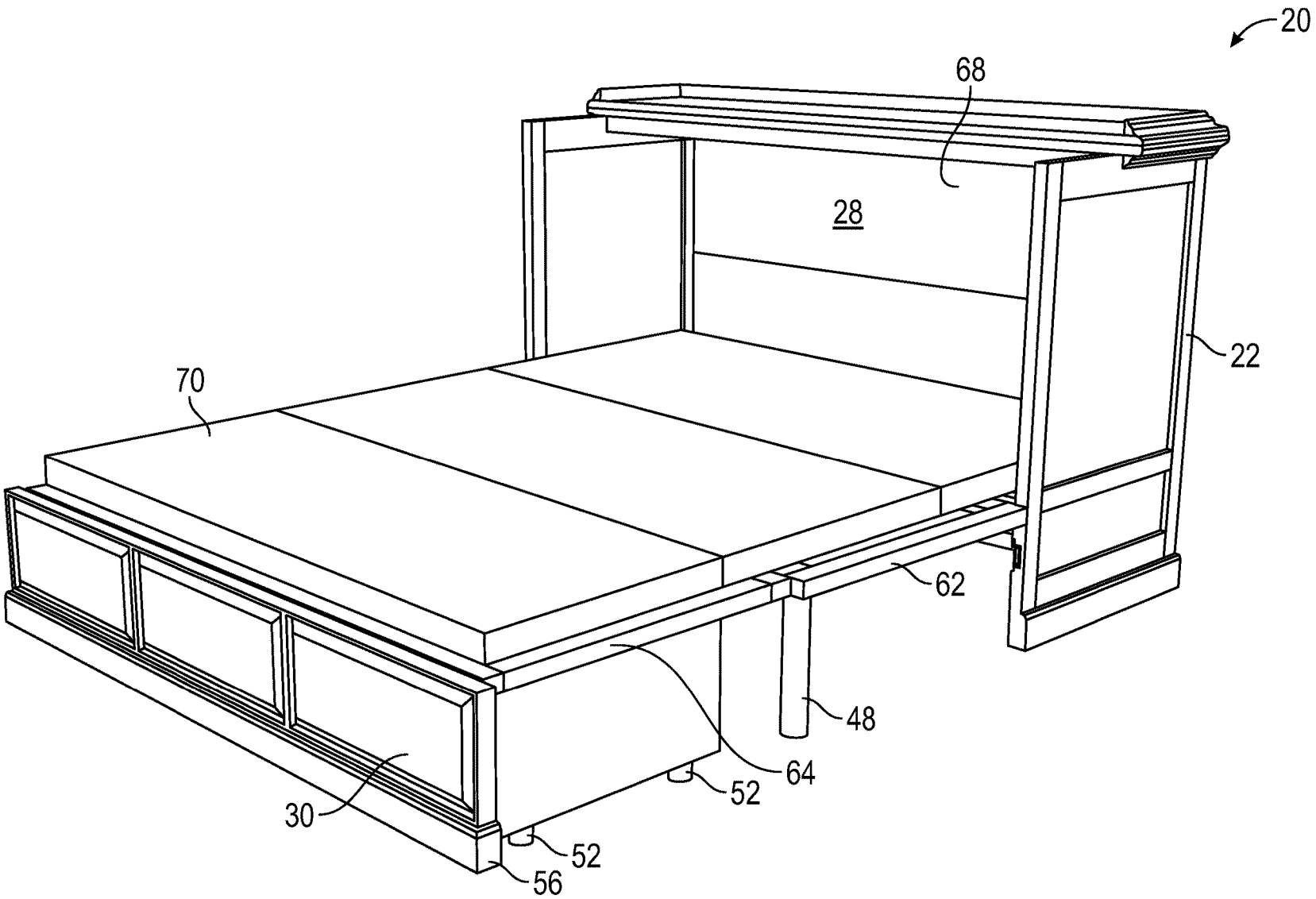
FIG. 8 is a front perspective view of the folding bed storage cabinet of FIG. 7 with a mattress.
Figure 9:
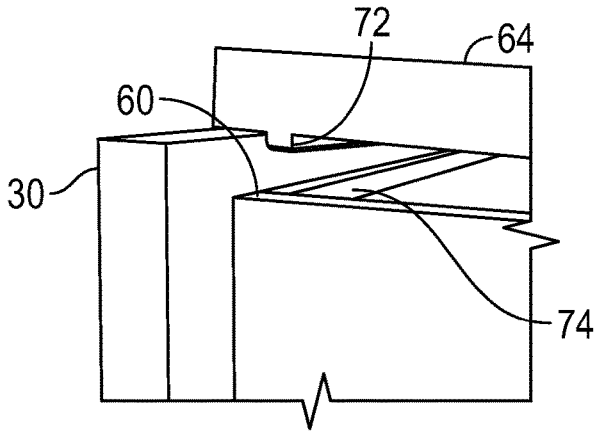
FIG. 9 is a close up perspective view of a securing portion of the folding bed storage cabinet according to one embodiment.

Cabinet 20 further includes a front panel 42 comprising a first (outer) sub panel 62 and a second (inner) sub panel 64. First front sub panel 62 is hingeably connected to the cabinet 20 at inner panel 26 and movable between a raised (closed) position (FIG. 3) and a lowered (deployed) position (FIG. 6). The second front subpanel 64 is hingeably mounted to the first front sub panel 62 and is movable between a first (closed) position where it lays against the first front sub panel 62 and a second (deployed) position (FIG. 7). The front panel 42 first subpanel 62 has an inner face 45 and an outer face 43. The outer face 43 may be finished and/or include trim and other decorative work so as to match the other cabinet panels. The second subpanel 64 has an inner face 65 and an outer face 63. When in the closed position the second subpanel 64 inner face 65 rests against the first subpanel 62 inner face 45. When in the deployed/open position the interior panel 26, first subpanel 42 inner face 45 and the second subpanel 64 inner face 65 are substantially coplanar and form a mattress platform 80 capable of supporting a mattress 70. The mattress platform 80 includes an end distal 81 from the cabinet body (located on the second front panel subpanel) and one proximal 79 to the cabinet body (located on the interior cabinet panel). The mattress 70 may be of any suitable style or design and made from any suitable material such as polyurethane/memory foam, gel-infused foam, polyfoam, latex, air bladders, and the like. Such mattresses may be a single piece or multiple smaller subsections (e.g., foldable mattresses) such as shown in FIG. 8 to allow for easier storage within the interior volume 68 of the cabinet 20. In this example, the second subpanel 64 is shown as having a lattice structure. This is for illustrative purposes only and the second subpanel 64 may be a solid panel in other examples.

Figure 10:
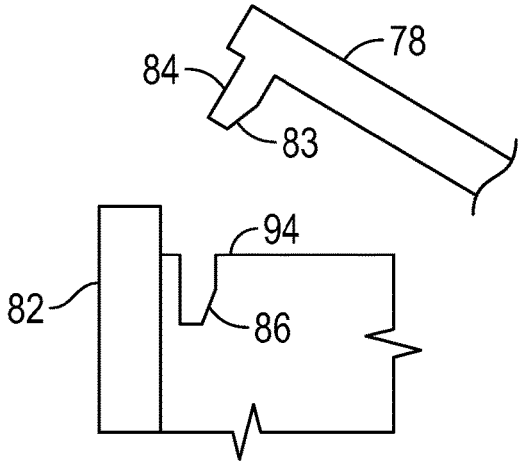
FIG. 10 is a close up perspective view of a securing portion of the folding bed storage cabinet according to another embodiment.

The second subpanel 64 outer face 63 further includes at least one securing feature 66 configured to secure the second subpanel 64 to the securing ledge 60 of the separable portion 30. In one example, the at least one securing feature 66 is a cleat 72 sized to fit within a corresponding groove or recess 74 on the securing ledge 60 of the separable portion 30. In the example shown in FIG. 10, the front panel second subpanel 78 has a cleat 84 having a profile with at least one sloped edge 83 which assists in guiding the cleat 84 into the corresponding groove or recess 86 located on the securing ledge 94 of the separable portion 82. The cleat 72 or 84 may extend across at least a majority of a lateral width of separable portion 30 or 82, and in an embodiment the cleat may extend at least 75% of that lateral width. The shape of cleats contemplated herein may include angular shapes such as those illustrated, including a square shape, a rectangular shape, a triangular shape, a trapezoidal shape, or still others. In other instances, the cleat could have a rounded or half-rounded profile, for example. The cleats may be formed integrally with the associated structure or as one or more strips that are attached via adhesive, fasteners, or other suitable means.

Figure 11:
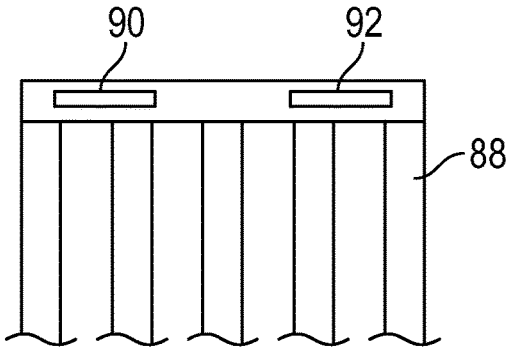
FIG. 11 is a close up perspective view of a securing portion of the folding bed storage cabinet according to still another embodiment.

In other examples, multiple securing cleats and corresponding grooves may be used such as shown in FIG. 11. In this example, the front panel second subpanel 88 includes a first securing cleat 90 and a second securing cleat 92 sized and shaped to securely fit within corresponding securing grooves on a separable platform (not shown). In still other examples, combinations of pins, dowels, or other projections along with corresponding holes, openings, or recesses may be used. Optionally, magnets and metal pieces or strip may be used to further assist in guiding a securing cleat and recess or other securing features into the correct position.

Methods of operating the cabinets disclosed herein will now be described. In one example, a cabinet such as shown and described above with respect to FIGS. 3-8 is provided in the closed position. The process of transitioning the cabinet to the open/deployed position may begin by the separable platform portion being pulled out from the separable portion storage area in the base of the cabinet body and the top panel first portion is lifted up and folded back onto the top panel second portion thereby exposing the support structure attachment points. The support legs (which may be stored in the separable platform interior when not in use) are then securely mounted to the support structure attachment points. The separable platform is then positioned an appropriate distance from the cabinet body. The exact distance between the separable platform and the cabinet body will vary according to the particular measurements of the cabinet, but it should be positioned approximately where the distal end of the mattress platform will be located when the cabinet front panel is unfolded. At this stage of the process the cabinet may look approximately like FIG. 5.

The cabinet front panel is then folded downward and away from the cabinet body. The cabinet may optionally include one or more latches 44, magnets, or other hardware creating a releasable connection between the cabinet body (sides and/or top) and the front panel so as to prevent the front panel from inadvertently folding downward prematurely. Once the cabinet front panel is folded down the support legs will be supporting the distal end of the front panel first subsection (which will form the medial section of the mattress platform once fully deployed). The separable platform may be repositioned (if necessary) and the front panel second subpanel unfolded from the front panel first subpanel and lowered until the distal end of the front panel second subpanel rests on the securing ledge of the separable platform. At this stage of the process the cabinet may look approximately like FIG. 7. The separable platform may be repositioned as necessary until the securing feature(s) (e.g., securing cleats) of the front panel second subpanel are secured to the securing feature(s) (e.g., securing recesses) of the securing ledge of the separable platform. When positioned correctly, the securing features prevent the separable platform from moving relative to the mattress platform inadvertently. In this deployed configuration, the distal end of the mattress platform (i.e, the front panel second subpanel) is fully supported by the separable platform. The mattress may then be positioned on the mattress platform (similar to FIG. 8) and the bed used. The mattress may be stored within the interior volume of the cabinet body or elsewhere, as desired.

Conversion of the cabinet from the open/deployed position to the closed/stowed position generally entails the opposite procedure. Beginning with a fully deployed cabinet bed similar to that shown in FIG. 8, the mattress is removed/stowed. The exact procedure will vary according to the type of mattress used and where it is to be stored when not in use. Once the mattress is removed, the front panel second subpanel is lifted up/folded back onto the front panel first subpanel. The front panel is then lifted/folded up until it is generally perpendicular to the interior cabinet panel and generally parallel to the cabinet back panel. If the cabinet includes any latches or other securing features the front panel may be secured to the cabinet body to prevent it from inadvertently folding down during the procedure. At this stage the cabinet may look similar to FIG. 5.

The support legs may then be removed from the support structure attachment points and returned to storage (which may be in the separable platform interior). The top panel first portion is lifted from the top panel second portion and folded down so as to cover the support structure attachment points. The separable platform portion is then repositioned so as to slide into the separable portion storage area in the base of the cabinet body, optionally after storing any pillows, blankets, or other bedding materials in the interior volume of the separable platform. The folding bed storage cabinet has then been returned to the closed/stowed configuration. Obvious variations of this procedure may also be used, for example, the top portion may be folded back and the support members attached to the cabinet front panel before the separable platform is removed from the cabinet.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A sleeper bed cabinet configured to transition between a stowed position and a deployed position, comprising:

a top panel having a first portion and a second portion, the first portion being configured to fold back onto the second portion, two side panels, and a rear panel defining an interior cabinet volume;

an interior panel disposed between the two side panels and below the top panel and dividing the interior cabinet volume into an upper interior volume and a lower interior volume;

a front panel having a first subpanel hingeably mounted to the interior panel and a second subpanel hingeably mounted to the first subpanel and having at least one securing cleat; and a separable platform stowable in the lower interior volume and having a securing ledge with at least one securing recess configured to accept the at least one securing cleat;

wherein the front panel is configured to transition between a stowed position and a deployed position, the first subpanel forming a medial mattress platform and the second subpanel forming a distal mattress platform in the deployed position;

wherein the separable platform is removable from the lower interior volume and positionable to form a support platform for the second front panel subpanel, such that the first subpanel is positioned between the lower interior volume and the separable platform;

wherein the at least one securing cleat is secured to the at least one securing recess when the separable platform is supporting the second front panel subpanel.

2. The sleeper bed cabinet of claim 1, further comprising a support leg and wherein the front panel first subpanel further includes a support leg attachment point positioned such that a support leg attached to the attachment point supports the front panel first subpanel when in the deployed position.

3. The sleeper bed cabinet of claim 2, wherein the top panel first portion covers the support leg attachment point when in the stowed position.

4. The sleeper bed cabinet of claim 1, further comprising a latch connecting the front panel to a side panel configured to secure the front panel in the stowed position.

5. The sleeper bed cabinet of claim 1, wherein the front panel first subpanel is solid and the front panel second subpanel is slatted.

6. The sleeper bed cabinet of claim 1, wherein the upper interior cabinet volume is sized to hold a mattress when the cabinet is in the stowed position.

7. The sleeper bed cabinet of claim 1, wherein the separable platform further includes an interior volume.

8. A sleeper bed cabinet configured to transition between an open position and a closed position, comprising:

a top panel having a first portion and a second portion, the first portion being hinged to fold back onto the second portion, two side panels, and a rear panel defining an interior cabinet volume;

an interior panel disposed between the two side panels and below the top panel dividing the interior cabinet volume into an upper interior volume and a lower interior volume and which forms a proximal portion of a sleeping platform when the cabinet is in the open position;

a front panel having a first subpanel hingeably mounted to the interior panel and a second subpanel hingeably mounted to the first subpanel and having at least one securing feature;

two support legs; and a separable platform stowable in the lower interior volume and having a securing ledge with at least one securing recess configured to accept the at least one securing feature;

wherein the front panel is configured to transition between a closed position and an open position, the first subpanel forming a medial portion of a sleeping platform and the second subpanel forming a distal portion of a sleeping platform when in the open position;

wherein the separable platform is removable from the lower interior volume and positionable to form a support platform for the second front panel subpanel;

wherein the at least one securing feature is secured to the at least one securing recess when the separable platform is supporting the second front panel subpanel;

wherein the front panel first subpanel further includes support leg attachment points positioned such that each support leg attached to a respective attachment point supports the front panel first subpanel when in the open position.

9. The sleeper bed cabinet of claim 8, wherein the at least one securing feature is a cleat.

10. The sleeper bed cabinet of claim 8, wherein the at least one securing feature is a dowel.

11. The sleeper bed cabinet of claim 8, wherein the top panel first portion covers the support leg attachment points when in the closed position.

12. The sleeper bed cabinet of claim 8, further comprising a latch connecting the front panel to a side panel configured to secure the front panel in the closed position.

13. The sleeper bed cabinet of claim 8, wherein the front panel first subpanel is a solid panel and the front panel second subpanel is a slatted panel.

14. The sleeper bed cabinet of claim 8, wherein the upper interior cabinet volume is sized to hold a mattress when the cabinet is in the closed position.

15. The sleeper bed cabinet of claim 8, wherein the separable platform further includes an interior volume.

16. A sleeper bed cabinet configured to transition between a stowed position and a deployed position, comprising:

a top panel having a first portion and a second portion, the first portion being hinged to fold back onto the second portion, two side panels, a rear panel, and a front panel defining a cabinet interior volume;

an interior panel disposed between the two side panels, the front and rear panels, and below the top panel dividing the cabinet interior volume into an upper interior volume and a lower interior volume, the interior panel forming a proximal portion of a mattress platform when the cabinet is in the deployed position;

the front panel comprising a solid first subpanel hingeably mounted to the interior panel and a slatted second subpanel hingeably mounted to the first subpanel; and a separable platform stowable in the lower interior volume;

wherein the front panel is configured to transition between a raised position when the cabinet is in the stowed position and a lowered position when the cabinet is in the deployed position, the first subpanel forming a medial portion of a mattress platform and the second subpanel forming a distal portion of a mattress platform when in the lowered position;

wherein the separable platform is removable from the lower interior volume and positionable to form a support platform for the second front panel subpanel at a location beneath the second front panel subpanel, and removing the separable platform exposes the lower interior volume and the support platform is spaced from the lower interior volume.

17. The sleeper bed cabinet of claim 16, wherein the upper interior cabinet volume is sized to hold a mattress when the cabinet is in the stowed position.

18. The sleeper bed cabinet of claim 16, wherein the separable platform further includes an interior volume.

19. The sleeper bed cabinet of claim 16, wherein the second subpanel further includes at least one securing cleat and the separable platform further includes at least one securing recess configured to accept the at least one securing cleat;

wherein the at least one securing cleat is secured to the at least one securing recess when the separable platform is supporting the second front panel subpanel.

* * * * *